US010633966B2

(12) United States Patent
Pollak et al.

(10) Patent No.: US 10,633,966 B2
(45) Date of Patent: Apr. 28, 2020

(54) SUBSEA ISOLATION SLEEVE SYSTEM

(71) Applicant: OneSubsea IP UK Limited, London (GB)

(72) Inventors: Joshua Pollak, Copley, OH (US); Claudio Santilli, Houston, TX (US)

(73) Assignee: ONESUBSEA IP UK LIMITED, London (GB)

( * ) Notice: Subject to any disclaimer, the term of this patent is extended or adjusted under 35 U.S.C. 154(b) by 0 days.

(21) Appl. No.: 15/833,013

(22) Filed: Dec. 6, 2017

(65) Prior Publication Data

US 2019/0169983 A1 Jun. 6, 2019

(51) Int. Cl.

| | |
|---|---|
| ***E21B 47/10*** | (2012.01) |
| ***E21B 47/00*** | (2012.01) |
| ***E21B 17/042*** | (2006.01) |
| ***E21B 34/04*** | (2006.01) |
| ***E21B 33/035*** | (2006.01) |

(52) U.S. Cl.

CPC ..... *E21B 47/1025* (2013.01); *E21B 17/042* (2013.01); *E21B 33/035* (2013.01); *E21B 34/04* (2013.01); *E21B 47/0001* (2013.01)

(58) Field of Classification Search

CPC ..... E21B 47/1025; E21B 47/0001; E21B 17/042; E21B 33/035; E21B 34/04

See application file for complete search history.

(56) References Cited

U.S. PATENT DOCUMENTS

| | | | | |
|---|---|---|---|---|
| 3,555,643 | A * | 1/1971 | Koppelmann | B24B 39/023 29/90.01 |
| 6,039,120 | A | 3/2000 | Wilkins et al. | |
| 8,727,012 | B2 | 5/2014 | Bhat | |
| 9,816,352 | B2 * | 11/2017 | Pickle | E21B 34/10 |
| 10,047,585 | B2 * | 8/2018 | Pickle | E21B 33/04 |
| 10,119,372 | B2 * | 11/2018 | Braithwaite | E21B 33/038 |
| 2003/0089501 | A1 * | 5/2003 | Hartmann | E21B 33/035 166/348 |
| 2004/0112604 | A1 * | 6/2004 | Milberger | E21B 33/035 166/368 |

(Continued)

FOREIGN PATENT DOCUMENTS

WO 2016069302 A1 5/2016

OTHER PUBLICATIONS

Extended European Search Report issued in European patent appl. No. 18210548.6 dated Jul. 12, 2019, 8 pages.

*Primary Examiner* — Matthew R Buck
*Assistant Examiner* — Aaron L Lembo

(57) ABSTRACT

A technique facilitates pressure testing of a seal positioned between a wellhead and a subsea tree system. The technique utilizes an isolation sleeve which may comprise a mandrel having an internal mandrel passage as well as a lower seal and an upper seal positioned along an exterior of the mandrel. The isolation sleeve also may comprise a retention member mounted along the exterior of the mandrel. The retention member, e.g. a retention nut, may be rotatably mounted about the exterior of the mandrel and may comprise external threads or other mechanism for securing the isolation sleeve to the subsea tree system. In some embodiments, the upper end of the isolation sleeve may be constructed in a uniform manner for insertion into a universal profile of the subsea tree system.

13 Claims, 5 Drawing Sheets

(56) References Cited

U.S. PATENT DOCUMENTS

| | | | | |
|---|---|---|---|---|
| 2011/0017467 | A1* | 1/2011 | June | E21B 33/043 166/368 |
| 2011/0061854 | A1* | 3/2011 | Davies | E21B 33/062 166/95.1 |
| 2012/0024536 | A1* | 2/2012 | Given | E21B 33/043 166/368 |
| 2012/0048567 | A1* | 3/2012 | June | E21B 33/035 166/368 |
| 2012/0111573 | A1 | 5/2012 | Bhat | |
| 2012/0211236 | A1 | 8/2012 | Braithwaite | |
| 2013/0175055 | A1* | 7/2013 | Hart | E21B 33/03 166/387 |
| 2014/0048277 | A1* | 2/2014 | June | E21B 33/035 166/348 |
| 2014/0116716 | A1* | 5/2014 | Vincent | E21B 43/01 166/351 |
| 2015/0021040 | A1* | 1/2015 | Johal | E21B 33/035 166/368 |
| 2016/0017680 | A1* | 1/2016 | June | E21B 33/035 166/344 |

* cited by examiner

SUBSEA ISOLATION SLEEVE SYSTEM

BACKGROUND

Hydrocarbon fluids such as natural gas and oil may be obtained from a subterranean geologic formation, referred to as a reservoir, by drilling a well that penetrates the hydrocarbon-bearing geologic formation. In many types of subsea applications, a wellhead is positioned at a sea floor above a wellbore drilled down into the subterranean geologic formation. A subsea tree system is mounted on the wellhead and both the subsea tree system and the wellhead have an internal passage through which various well equipment may be deployed. A seal is positioned between the subsea tree system and the wellhead to ensure a pressure tight seal between the internal passage and the surrounding environment. An isolation sleeve may be used to facilitate pressure testing of the seal.

SUMMARY

In general, a system and methodology are provided for facilitating pressure testing of a seal positioned between a wellhead and a subsea tree system. The technique utilizes an isolation sleeve having an upper end inserted into an internal passage of the subsea tree system. The isolation sleeve extends from the subsea tree system for insertion into the corresponding internal wellhead passage when the subsea tree system is landed on the wellhead. The isolation sleeve may comprise a mandrel having an internal mandrel passage as well as a lower seal and an upper seal positioned along an exterior of the mandrel. The isolation sleeve also may comprise a retention member mounted along the exterior of the mandrel. According to an embodiment, the retention member, e.g. a retention nut, may be rotatably mounted about the exterior of the mandrel and comprises external threads or other suitable mechanism for securing the isolation sleeve to the subsea tree system. In some embodiments, the upper end of the isolation sleeve may be constructed in a uniform manner for insertion into a universal profile of the subsea tree system. This approach enables multiple types of isolation sleeves to be constructed with the same upper end, thus reducing costs and time of preparation with respect to various isolation sleeves which may be used with many types of wellheads having differing internal wellhead passage configurations, e.g. different passage diameters.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
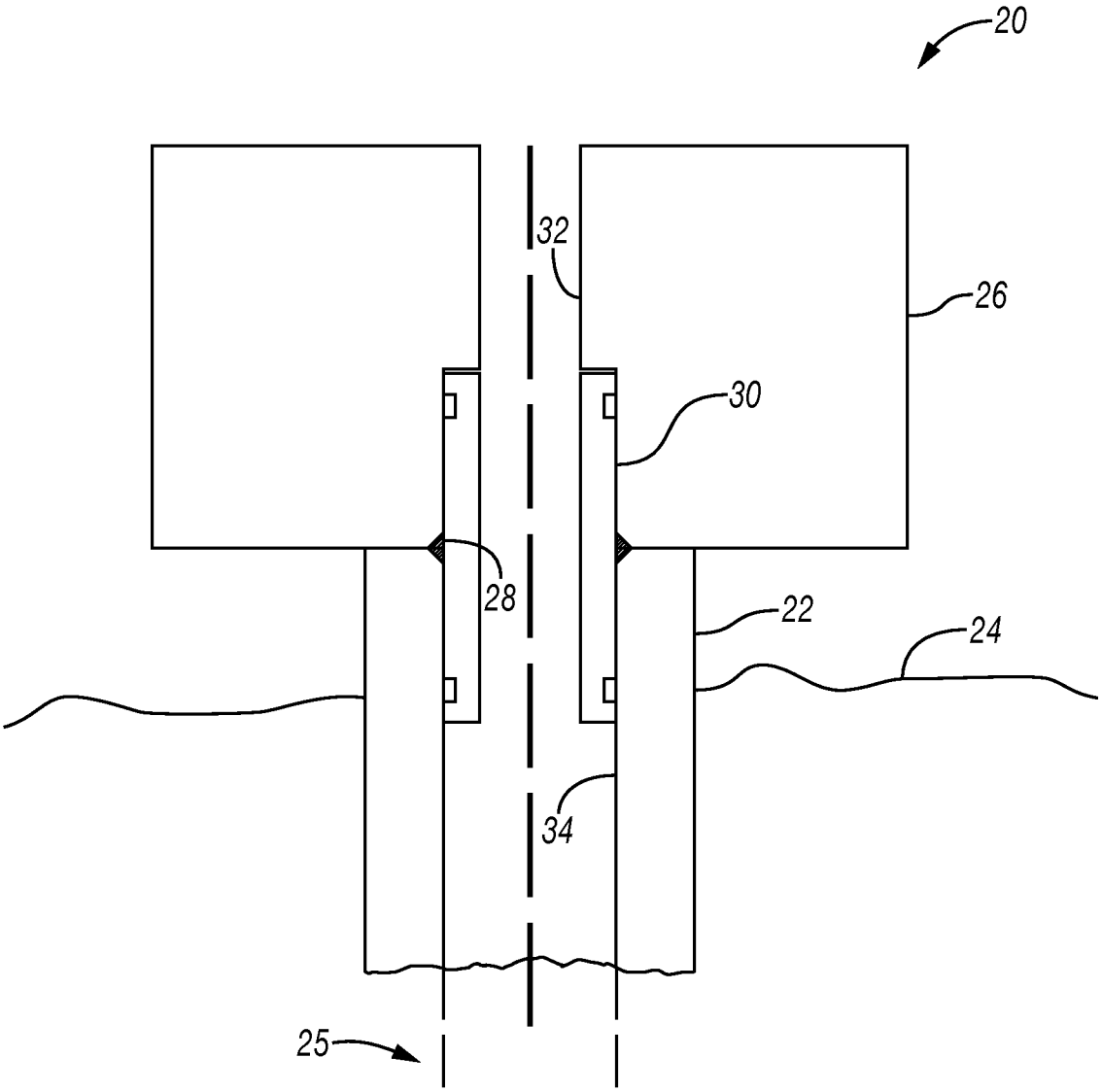
FIG. 1 is a schematic illustration of an example of a subsea tree system engaged with a wellhead at a subsea location, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology for facilitating pressure testing of a seal positioned between a wellhead and a subsea tree system. The technique utilizes an isolation sleeve having an upper end inserted into an internal passage of the subsea tree system. By way of example, the subsea tree system may comprise a Christmas tree, e.g. a vertical Christmas tree, or a tubing head spool into which the upper end of the isolation sleeve is inserted.

The isolation sleeve extends from the subsea tree system for insertion into the corresponding internal wellhead passage when the subsea tree system is landed on the wellhead. The isolation sleeve may comprise a sleeve body referred to as a mandrel which has an internal mandrel passage. Additionally, the isolation sleeve comprises a lower seal and an upper seal positioned along an exterior of the mandrel.

The isolation sleeve also may comprise a retention member mounted along the exterior of the mandrel. According to an embodiment, the retention member, e.g. a retention nut, is rotatably mounted about the exterior of the mandrel and comprises external threads for securing the isolation sleeve to the subsea tree system. The retention member may be rotated independently of the mandrel and upper/lower seals to secure the isolation sleeve to the subsea tree system.

In some embodiments, the upper end of the isolation sleeve may be constructed in a uniform manner for insertion into a universal profile of the subsea tree system. This approach enables multiple types of isolation sleeves to be constructed with the same upper end profile, thus reducing costs and time of preparation. The lower ends of the isolation sleeves may be designed for use with many types of wellheads having differing internal wellhead passage configurations/diameters. In other words, isolation sleeves for use with many different types of wellheads, e.g. various third-party wellheads, may be similarly constructed with a universal upper profile for reception in the universal profile of the corresponding subsea tree systems.

According to an embodiment, the retention nut and mandrel are constructed to allow external installation and activation of the retention nut whether the upper seal or lower seal has a larger diameter than the other. This configuration enables the external installation and activation of the retention nut regardless of whether the lower section of the isolation sleeve seals against a larger bore wellhead, smaller bore wellhead, or against another wellhead component such as a third position casing hanger.

Additionally, the isolation sleeve may be constructed with a single piece mandrel having leak paths along the isolation sleeve limited to two positions, i.e upper seal and lower seal, along the exterior of the mandrel. The retention nut or other retention member may be rotated independently of the upper and lower isolation sleeve seals, and the rotation may be performed via a single set of externally-installed assembly tooling. Furthermore, the configuration of the isolation sleeve enables removal, installation, or replacement of the seal between the subsea tree system and the wellhead independently of the isolation sleeve. In other words, the isolation sleeve does not interfere with the removal/installation/replacement processes.

Depending on the features utilized in a particular isolation sleeve, embodiments described herein may provide various benefits. By way of example, the use of a universal profile allows the bottom of each subsea tree system to be uniformly machined with the universal profile for receipt of various types of isolation sleeves having the corresponding uniform upper sleeve profile. With the universal profile, the upper seal used on the isolation sleeve may be preselected for use in the universal profile and this can eliminate the time and expense associated with qualifying a new seal size and type.

Furthermore, constructing the isolation sleeve with a single piece mandrel having a single, continuous structure limits the potential leak paths to a total of three leak paths, i.e. two potential leak paths at the upper and lower seals of the isolation sleeve and one potential leak path at the seal between the wellhead and subsea tree system. Such a single, unitary structure avoids construction of the isolation sleeve with a multi piece mandrel which would effectively establish additional potential leak paths. The use of a universal profile also enables construction of subsea tree systems with a predefined and minimized space allocation for the isolation sleeve. Without the universal profile, additional space would be provided at the bottom of the subsea tree system to accommodate different types of isolation sleeves having different upper profiles. Such oversized systems incur additional costs as well as additional weights and heights.

Referring generally to FIG. 1, an example of a subsea well system 20 is illustrated. In this embodiment, the subsea well system 20 comprises a subsea wellhead 22 located at a seabed 24 above a wellbore 25. A subsea tree system 26 may be landed on the subsea wellhead 22 and sealed thereto via a seal 28, e.g. a metal gasket or other suitable seal. The subsea tree system 26 may comprise, for example, a tubing head spool sealed directly to the wellhead 22 or a Christmas tree sealed directly to the wellhead 22 with seal 28. An isolation sleeve 30 extends from an internal passage 32 of the subsea tree system 26 into an internal wellhead passage 34 of wellhead 22. The isolation sleeve 30 is sealed against the interior of the subsea tree system 26 and the interior of wellhead 22 to enable pressure testing of seal 28.

Figure 2:
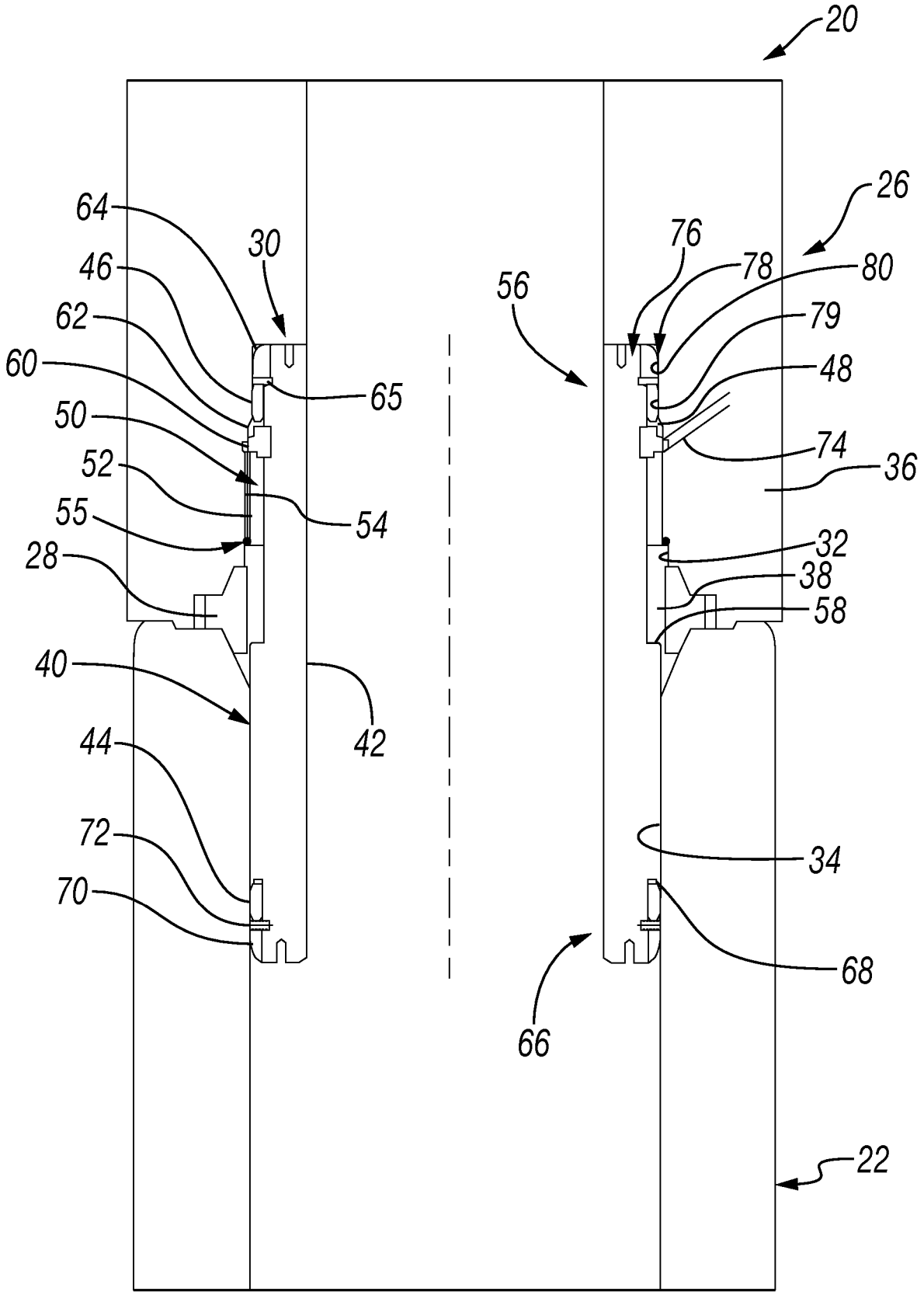
FIG. 2 is a cross-sectional illustration of an example of an isolation sleeve engaged between a subsea tree system and a wellhead, according to an embodiment of the disclosure.

Referring generally to FIG. 2, an embodiment of the isolation sleeve 30 is illustrated. In this example, the isolation sleeve 30 is disposed within the subsea tree system 26 (which may comprise a tubing head spool 36) and the wellhead 22. The isolation sleeve 30 extends from the internal passage 32 and into the wellhead passage 34 to provide a pressure test region 38 for pressure testing seal 28.

According to the illustrated embodiment, the isolation sleeve 30 comprises a mandrel 40 having an internal mandrel passage 42. The isolation sleeve 30 also comprises a lower seal 44 and an upper seal 46 which are both positioned along an exterior surface 48 of mandrel 40. The lower seal 44 is positioned for sealing engagement with the wellhead 22 and the upper seal 46 is positioned for sealing engagement with the subsea tree system 26. According to the embodiment illustrated, mandrel 40 is formed as a single, continuous structure. In other words, the mandrel 40 may be constructed as a unitary piece instead of joining a plurality of pieces that would be attached and sealed together to form the mandrel—thus creating additional potential leak paths.

Additionally, the isolation sleeve 30 comprises a retention member 50 which may be rotatably mounted along the exterior 48 of mandrel 40. By way of example, the retention member 50 may be located between the upper seal 46 and the lower seal 44. The retention member 50 may have various forms such as a ring having external threads 52 oriented for threaded engagement with corresponding threads 54 located along the internal passage 32 of subsea tree system 26. However, the retention member 50 may be secured via retention rings or other retention mechanisms instead of threads 52.

In the example illustrated, the retention member 50 is in the form of a retention nut. The outer diameter of the mandrel 40 is selected to enable external rotation of the retention member 50 via a single set of externally-installed assembly tooling. Additionally, the retention member 50, e.g. retention nut, may be rotatable independently of mandrel 40 and the lower and upper seals 44, 46.

After assembly of isolation sleeve 30, the isolation sleeve 30 may be inserted into internal passage 32 and retention member 50 may be rotated to secure its engagement with subsea tree system 26 via threads 52, 54. A retention mechanism 55, e.g. a split metal O-ring, may be positioned between mandrel 40 and retention member 50 to prevent backing off of threads 52 and 54. In some embodiments, retention mechanism 55 may be located between retention member 50 and subsea tree system 26 along internal passage 32.

According to an embodiment, the retention member/nut 50 is initially slid over an upper end 56 of mandrel 40 but its travel along the upper end 56 is limited by an abutment 58 formed along mandrel 40. After sliding the retention member 50 onto mandrel 40, a load ring 60, e.g. a split load ring, is secured along the exterior 48 of mandrel 40 and serves as another abutment. Thus, the retention member 50 is trapped between abutment 58 and the abutment provided by load ring 60.

In some embodiments, a retainer ring 62 may be positioned on mandrel 40 to further support and retain load ring 60 during loading. By way of example, the retainer ring 62 may be free-floating but limited in movement by load ring 60 below and upper seal 46 above. The retainer ring 62 also could be secured to mandrel 40 via at least one set screw or other suitable fastening mechanism. It should be noted substantial loads may be applied against the retention member 50 and load ring 60 during pressure testing of seal 28, particularly when lower seal 44 and upper seal 46 have different diameters.

Once the load ring 60 is positioned and secured in place, the upper seal 46 may be positioned above the load ring 60 and secured in place via an upper seal retainer 64, e.g. a seal retainer nut, which may be threaded onto mandrel 40. A set screw 65 or other retention member may be used to secure the upper seal retainer 64 in place. Similarly, the lower seal 44 may be slid over a lower end 66 of the mandrel 40 proximate a seal abutment 68. The lower seal 44 may then be secured via a lower seal retainer 70, e.g. a seal retainer nut, which may be threaded onto mandrel 40. A corresponding set screw 72 or other retention member may be used to secure the lower seal retainer 70 in place. After securing the isolation sleeve 30 between the subsea tree system 26 and wellhead 22, the seal 28 may be pressure tested by supplying pressure test region 38 with pressurized fluid via a suitable pressure passage 74 through subsea tree system 26. The pressure passage 74 may be placed in communication with pressure test region 38 at, for example, a location below retention member 50 or via a pressure bypass conduit in retention member 50.

In the embodiment illustrated in FIG. 2, the upper end 56 along with retention member 50, load ring 60, and upper seal 46 may be arranged to provide a universal sleeve profile 76 for receipt in a universal profile 78 formed within the subsea tree system 26 along the internal passage 32. By way of example, the universal profile 78 comprises a universal seal region 79 for receiving upper seal 46 and a universal retention region 80 for receiving retention member 64. The universal profile 78 and corresponding universal sleeve profile 76 may be used with many types of isolation sleeves 30 having lower ends 66 of various diameters and configurations. For example, the lower end 66 of the isolation sleeve 30 illustrated in FIG. 2 is constructed for use with wellhead 22 having a large bore wellhead passage 34. In this type of embodiment, the lower seal 44 has a larger diameter than the upper seal 46.

Figure 3:
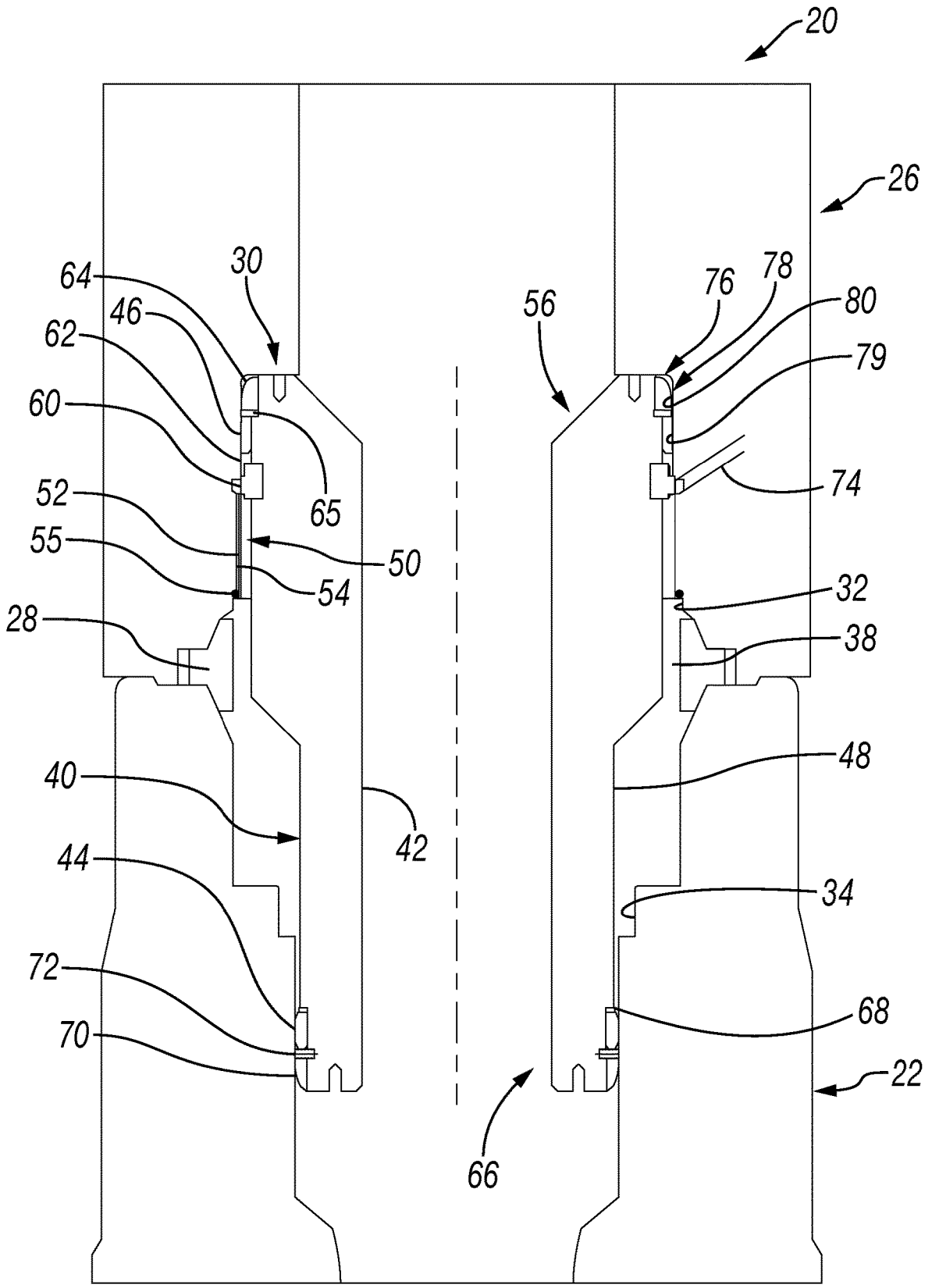
FIG. 3 is a cross-sectional illustration of another example of an isolation sleeve engaged between a subsea tree system and a wellhead, according to an embodiment of the disclosure.

Referring generally to FIG. 3, another embodiment of isolation sleeve 30 is illustrated as having the same universal sleeve profile 76 for engagement with the universal profile 78. However, the lower end 66 of the isolation sleeve 30 has a different configuration. In this latter embodiment, the wellhead 22 has a small bore wellhead passage 34 and the upper seal 46 has a larger diameter than the lower seal 44. When using the smaller diameter lower end 66, the abutment 58 may be omitted along an exterior 48 of mandrel 40. It should be noted the universal profile 78 may be used with various other types of isolation sleeves 30 having a variety of lower ends constructed to match, for example, the unique characteristics of different types of wellheads 22.

Figure 4:
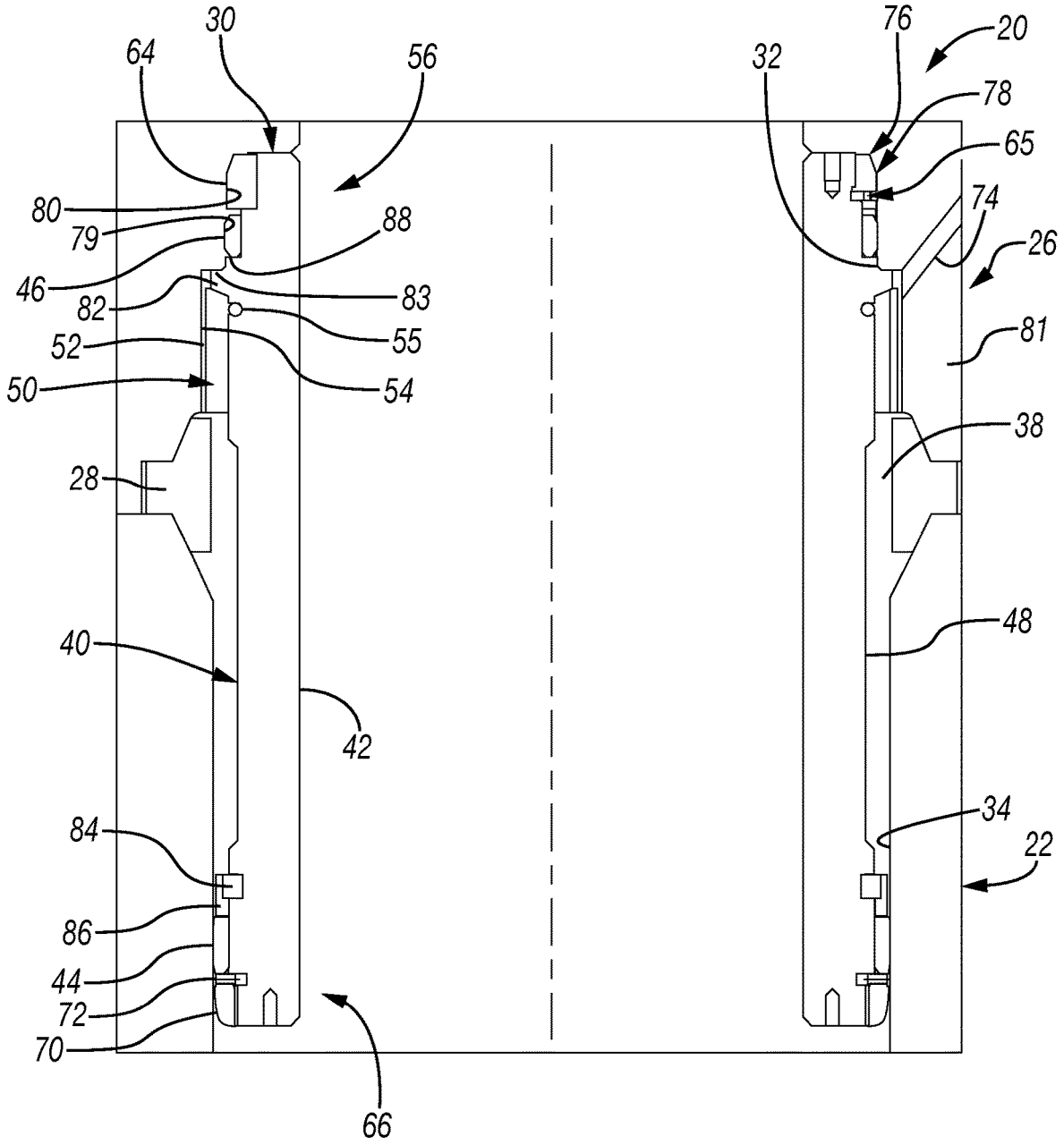
FIG. 4 is a cross-sectional illustration of another example of an isolation sleeve engaged between a subsea tree system and a wellhead, according to an embodiment of the disclosure.

Referring generally to FIG. 4, another embodiment of isolation sleeve 30 is illustrated. In this example, the isolation sleeve 30 is again disposed within the subsea tree system 26 (which may comprise a Christmas tree 81) and the wellhead 22. This embodiment of isolation sleeve 30 similarly extends from the internal passage 32 and into the wellhead passage 34 to provide the pressure test region 38 for pressure testing seal 28.

The isolation sleeve 30 may be secured in subsea tree system 26 via threaded engagement of retention member 50. For example, retention member 50 may be independently rotated about mandrel 40 to engage threads 52 with threads 54. The retention mechanism 55, e.g. a split metal O-ring, may be positioned between mandrel 40 and retention member 50 to prevent backing off of threads 52 and 54.

During assembly of the isolation sleeve 30 illustrated in FIG. 4, the retention member/nut 50 is initially slid over lower end 66 of mandrel 40 and its travel along the exterior 48 of mandrel 40 is limited by an upper abutment 82 formed along mandrel 40. Upper abutment 82 may engage a corresponding abutment 83 along internal passage 32 to provide additional support against loading. It should be noted the mandrel 40 may be turned upside down during assembly of this embodiment of isolation sleeve 30. After sliding the retention member 50 onto mandrel 40, a load ring 84, e.g. a split load ring, is secured along the exterior 48 of mandrel 40 and serves as another abutment.

In this example, the load ring 84 may be positioned so it will be proximate lower seal 44 and below retention member 50. The load ring 84 may serve as a seal abutment for lower seal 44. Additionally, the retention member 50 is trapped between upper abutment 82 and the lower abutment provided by load ring 84. In some embodiments, a retainer ring 86 may be mounted on mandrel 40 to further support and retain load ring 84. By way of example, the retainer ring 86 may be free-floating but limited in movement by load ring 84 above and lower seal 44 below. The retainer ring 86 also could be secured to mandrel 40 via at least one set screw or other suitable fastening mechanism.

Once the load ring 84 is positioned and secured in place, the lower seal 44 may be slid over lower end 66 and located at its operational position below the load ring 84. The lower seal 44 may be secured in place via lower seal retainer 70, e.g. a seal retainer nut, which may be threaded onto mandrel 40. The set screw 72 or other retention member may be used to secure the lower seal retainer 70 in place.

Similarly, the upper seal 46 may be slid over the upper end 56 of mandrel 40 until it bottoms out on a shoulder 88 of mandrel 40. The upper seal 46 may then be secured via upper seal retainer 64, e.g. a seal retainer nut, which may be threaded onto mandrel 40. The corresponding set screw 65 or other retention member may be used to secure the upper seal retainer 64 in place. After securing the isolation sleeve 30 between the subsea tree system 26 and wellhead 22, the seal 28 may similarly be pressure tested by supplying pressure test region 38 with pressurized fluid via the pressure passage 74 through subsea tree system 26.

In the embodiment illustrated in FIG. 4, the upper end 56 along with the upper seal 46 and seal retainer 64 may be arranged to provide the universal sleeve profile 76 for receipt in the corresponding universal profile 78 formed within the subsea tree system 26 along internal passage 32. The universal profile 78 may again comprise a universal seal region 79 for receiving upper seal 46 and a universal retention region 80 for receiving retention member 64. As with other embodiments described herein, the universal profiles 76, 78 may be used with many types of isolation sleeves 30 having lower ends 66 of various diameters and configurations. For example, the lower end 66 of the isolation sleeve 30 illustrated in FIG. 4 is constructed for use with wellhead 22 having a large bore wellhead passage 34. In this type of embodiment, the lower seal 44 has a larger diameter than the upper seal 46.

Figure 5:
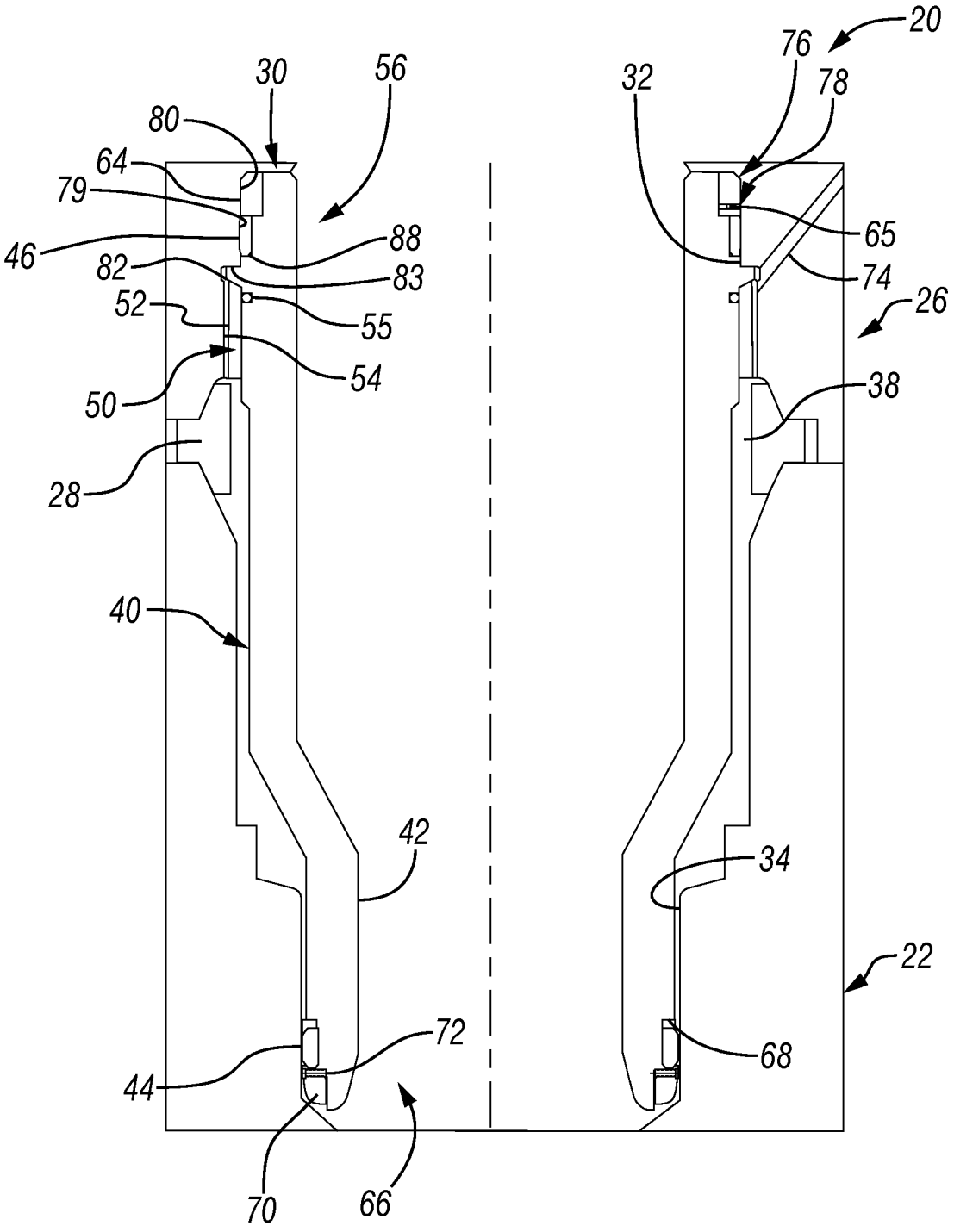
FIG. 5 is a cross-sectional illustration of another example of an isolation sleeve engaged between a subsea tree system and a wellhead, according to an embodiment of the disclosure.

Referring generally to FIG. 5, a similar embodiment of isolation sleeve 30 is illustrated as having the same universal sleeve profile 76 for engagement with universal profile 78. However, the lower end 66 of the isolation sleeve 30 has a different configuration. In this latter embodiment, the wellhead 22 has a small bore wellhead passage 34 and the upper seal 46 has a larger diameter than the lower seal 44.

Accordingly, embodiments of isolation sleeve 30 have various types of mandrels. Each mandrel 40 serves as an isolation sleeve body to which lower seal 44 and upper seal 46 may be mounted to seal and isolate the pressure test region 38 for pressure testing seal 28. The retention member 50 may be rotated independently of the mandrel 40 and isolation sleeve seals 44, 46 to secure and retain the isolation sleeve 30 in the subsea tree system 26. The retention member 50 also may be installed externally of the mandrel 40 regardless of the wellhead geometry.

Various split rings and other retainer rings may be used to support components of the isolation sleeve 30 and to provide a load path for system loads. The isolation sleeve 30 also may be constructed with a universal profile at its upper end for engagement with a corresponding universal profile of the subsea tree system 26. Other and/or additional components may be used with isolation sleeve 30 to facilitate pressure testing operations in a variety of environments and with many types of subsea installations.

For example, the isolation sleeve 30 may be used with many types of subsea tree systems 26 and may be secured within, for example, a tubing head spool or a Christmas tree. Additionally, the isolation sleeve 30 may comprise various types and sizes of seals, load rings, seal retainers, and other components to facilitate pressure testing operations. The retention member 50 also may have a variety of forms with various thread types for engaging the interior of subsea tree system 26. Depending on the arrangement of components, the retention member 50 may be positioned on the mandrel 40 from the top end or from the bottom end. Various abutments may be used to contain the retention member 50 and to provide load paths for loading resulting from pressure differentials or other types of loading experienced by the isolation sleeve 30.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a subsea operation, comprising:
- a wellhead having an internal wellhead passage;
- a subsea tree system having an internal passage, the subsea tree system being sealably coupled with the wellhead via a seal; and
- an isolation sleeve extending from the internal passage of the subsea tree system into the internal wellhead passage to facilitate pressure testing of the seal, the isolation sleeve comprising:
  - a mandrel formed as a single, continuous structure having an internal mandrel passage;
  - a lower seal position along an exterior of the mandrel for sealing engagement with the wellhead;
  - an upper seal positioned along the exterior of the mandrel for sealing engagement with the subsea tree system;
  - a retention nut mounted along the exterior of the mandrel by moving the retention nut a sufficient distance along the exterior of the mandrel to enable subsequent positioning of the upper seal above the retention nut along the exterior of the mandrel, the retention nut being threadably engaged with the subsea tree system along the internal passage; and
  - an upper seal retainer mounted to the mandrel above the upper seal to secure the upper seal along the mandrel, the upper seal retainer being sized to accommodate insertion into the internal passage of the subsea tree system.

2. The system as recited in claim 1, wherein the subsea tree system comprises a Christmas tree, the retention nut being threadably engaged with the Christmas tree.

3. The system as recited in claim 1, wherein the subsea tree system comprises a tubing head spool, the retention nut being threadably engaged with the tubing head spool.

4. The system as recited in claim 1, wherein the lower seal has a larger diameter than the upper seal.

5. The system as recited in claim 1, wherein the upper seal has a larger diameter than the lower seal.

6. The system as recited in claim 1, wherein the retention nut is slid onto the mandrel along the exterior of the mandrel and contained by at least one of an upper mandrel abutment and a lower mandrel abutment.

7. The system as recited in claim 6, wherein the upper mandrel abutment comprises a split ring.

8. The system as recited in claim 1, wherein the lower seal and the upper seal are secured in place along the mandrel via a lower seal retainer and an upper seal retainer, respectively.

9. A system, comprising:
- an isolation sleeve for subsea pressure testing, the isolation sleeve comprising:
  - a mandrel having an internal mandrel passage;
  - a lower seal positioned along an exterior of the mandrel;
  - an upper seal;
  - a retention member positioned along the exterior of the mandrel by sliding the retention member a sufficient distance along the exterior of the mandrel to enable subsequent positioning of the upper seal above the retention member along the exterior of the mandrel, the retention member being constructed for secure engagement with a subsea tree system; and
  - an upper seal retainer mounted to the mandrel above the upper seal to secure the upper seal along the mandrel.

10. The system as recited in claim 9, wherein the retention member is rotatably positioned adjacent an abutment along the mandrel, the retention member having external threads oriented for threaded engagement with a subsea tree system.

11. The system as recited in claim 10, wherein the retention member comprises a retention mechanism to resist unthreading of the retention member after being threadably engaged with the subsea tree system.

12. The system as recited in claim 9, wherein the lower seal has a larger diameter than the upper seal.

13. The system as recited in claim 9, wherein the upper seal has a larger diameter than the lower seal.

* * * * *